US010842209B2

(12) United States Patent
Kennedy et al.

(10) Patent No.: US 10,842,209 B2
(45) Date of Patent: Nov. 24, 2020

(54) CONVERTIBLE GARMENT WITH INTEGRAL CARRYING STRAP

(71) Applicants: Cassandra Kennedy, Hendersonville, TN (US); James Nickolas Smith, Hendersonville, TN (US)

(72) Inventors: Cassandra Kennedy, Hendersonville, TN (US); James Nickolas Smith, Hendersonville, TN (US)

( * ) Notice: Subject to any disclaimer, the term of this patent is extended or adjusted under 35 U.S.C. 154(b) by 0 days.

(21) Appl. No.: 15/875,718

(22) Filed: Jan. 19, 2018

(65) Prior Publication Data

US 2018/0199647 A1 Jul. 19, 2018

Related U.S. Application Data

(60) Provisional application No. 62/448,087, filed on Jan. 19, 2017.

(51) Int. Cl.

| | |
|---|---|
| ***A41D 27/22*** | (2006.01) |
| ***A41D 3/02*** | (2006.01) |
| ***A41D 15/04*** | (2006.01) |
| ***A41D 1/04*** | (2006.01) |

(52) U.S. Cl.

CPC ..... *A41D 27/22* (2013.01); *A41D 1/04* (2013.01); *A41D 3/02* (2013.01); *A41D 15/04* (2013.01); *A41D 2300/32* (2013.01); *A41D 2300/322* (2013.01); *A41D 2300/326* (2013.01); *A41D 2300/33* (2013.01); *A41D 2300/332* (2013.01)

(58) Field of Classification Search

CPC ..... A41D 3/02; A41D 15/04; A41D 27/22
See application file for complete search history.

(56) References Cited

U.S. PATENT DOCUMENTS

| | | | | | |
|---|---|---|---|---|---|
| 4,307,470 | A * | 12/1981 | Ezell | A41D 3/00 | 2/108 |
| 4,347,629 | A * | 9/1982 | Itoi | A41D 3/00 | 2/108 |
| 4,475,251 | A * | 10/1984 | Hopkins | A45C 9/00 | 2/85 |
| 4,637,076 | A * | 1/1987 | Tartt | A45F 4/12 | 190/107 |
| 4,944,042 | A * | 7/1990 | DeWan | A41D 15/04 | 190/1 |
| 5,278,998 | A * | 1/1994 | Book | A41D 13/0012 | 190/1 |
| 2008/0235849 | A1* | 10/2008 | McCray-Clark | A41D 3/02 | 2/85 |
| 2009/0055991 | A1* | 3/2009 | Johnson | A41D 1/04 | 2/84 |
| 2011/0079623 | A1* | 4/2011 | McCray-Clark | A41D 15/04 | 224/576 |
| 2014/0331381 | A1* | 11/2014 | Arajakis | A41D 3/005 | 2/84 |
| 2015/0150319 | A1* | 6/2015 | Walmsley | A41D 15/04 | 2/69.5 |
| 2016/0174633 | A1* | 6/2016 | MacRae | A45F 4/12 | 2/69.5 |

FOREIGN PATENT DOCUMENTS

| | | | | |
|---|---|---|---|---|
| FR | 2794000 A1 * | 12/2000 | ..... | A41D 15/04 |
| GB | 2448922 A * | 11/2008 | ..... | A41D 15/04 |
| GB | 2525790 * | 11/2015 | ..... | A41D 15/04 |

* cited by examiner

*Primary Examiner* — Christopher R Harmon

(57) ABSTRACT

An outergarment has a shoulder strap attached to an upper portion thereof.

11 Claims, 10 Drawing Sheets

CONVERTIBLE GARMENT WITH INTEGRAL CARRYING STRAP

CROSS-REFERENCE TO RELATED APPLICATIONS

This application claims priority to Provisional Application No. 62/448,087 filed Jan. 19, 2017.

STATEMENT REGARDING FEDERALLY SPONSORED RESEARCH

Not Applicable

FIELD OF THE INVENTION

This invention relates to a garment that can be converted into a bag.

BACKGROUND OF THE INVENTION

Outer garments such as coats, sweaters, sweatshirts, and other types of outerwear are often worn, especially in winter months. However, changes in weather and temperature, as well as protracted periods indoors, may force people to take off and carry their outerwear as they go about their business. This can be awkward because most outerwear is not designed to be carried easily, further when carried the garment is now just another item to carry, but a garment that can be converted into a bag when no longer desired to be worn provides added utility and is desirable.

The instant invention as disclosed within this application, fills this desirable need and provides a garment that can be converted into a bag when desired. The art referred to and/or described within this application is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

Among other things, this application presents a concept of a outergarment having a strap that can be used to carry the outergarment over one's shoulder. An outergarment with a shoulder strap attached to an upper portion thereof. As used herein, the term outergarment is used because generally the inventive garment having the strap is worn on the outside of other clothes. However, the inventive garment could be worn under one or more other garments. Further, the terms outergarment, coat, blazer, cardigan, sweater, sweatshirt may be used in the application, but it should be recognized that when used, any of these terms can be applied to any outergarment whether outside of other clothes or worn under other clothes. Also, multiple styles of coats or sweaters or other garments are illustrated here. These different illustrated styles should be viewed as showing that multiple types and styles of garments can be used and each of the embodied mechanisms for carrying a removed garment or removed garment converted into a bag or tote can be used for each of the differing garment types and styles. For instance, the style and/or type differences of the garment of FIG. 1 and the garment of FIG. 7 do not prevent the straps and fasteners of FIG. 7 to be used with FIG. 1 and vice versa.

In some embodiments of the inventive outergarment, the outergarment can have a shoulder strap that is attached at the upper portion of the outergarment. However, the strap can extend from the bottom or middle of the garment in some embodiments. In some embodiments, the outergarment has a shoulder strap that is permanently attached to an interior side of the upper portion of the outergarment.

In some embodiments, the outergarment can have a pouch integrated into the upper portion of the outergarment wherein the shoulder strap is secured to one or both of 1) the outergarment or 2) the pouch such that it is storable within the pouch.

In some embodiments of the outergarment, the pouch can be disposed under or proximate to a collar of the outergarment on the upper portion.

In some embodiments, the pouch can comprise a fastener or a set of fasteners to releasably close the pouch.

In some embodiments, the shoulder strap can be releasably attached to the upper portion.

In some embodiments, the outergarment can further comprise: a first sleeve and a second sleeve attached to a central portion; at least one cord extending proximate of the end of the first sleeve to proximate of the end of a second sleeve, the at least one cord passing through the central portion; the cord having a handle; the handle disposed within the central portion; wherein when the handle is pulled, the two sleeves are drawn inward, toward the central portion, and the at least one cord, extended, serves as the shoulder strap.

In some embodiments, the at least one cord can extend, at least partially, between two material layers of the outergarment.

In some embodiments, the outergarment can have a pair of openings through which the at least one cord protrudes to expose the handle.

In some embodiments, the at least one cord can be elastic.

In some embodiments, the at least one cord can be enclosed within a tube as it runs between the central portion and the ends of the two sleeves.

In some embodiments, a bottom portion can include a closing mechanism to close the bottom portion of the outergarment to secure items placed in the outergarment, the closing mechanism can be selected from the group consisting of: a draw string, a zipper, a hook and loop material, a button and loop mechanism, a clasp and loop or hole mechanism, a magnet mechanism, a folding mechanism, and any combination thereof.

In some embodiments the outergarment can further comprise upper and lower sets of complementary fasteners spaced from one another vertically along the outergarment.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A detailed description of the invention is hereafter described with specific reference being made to the drawing.

FIG. 18 is a schematic front elevational view of the coat of FIGS. 15-17 illustrating the retractable carrying strap extended with the sleeves pulled in.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
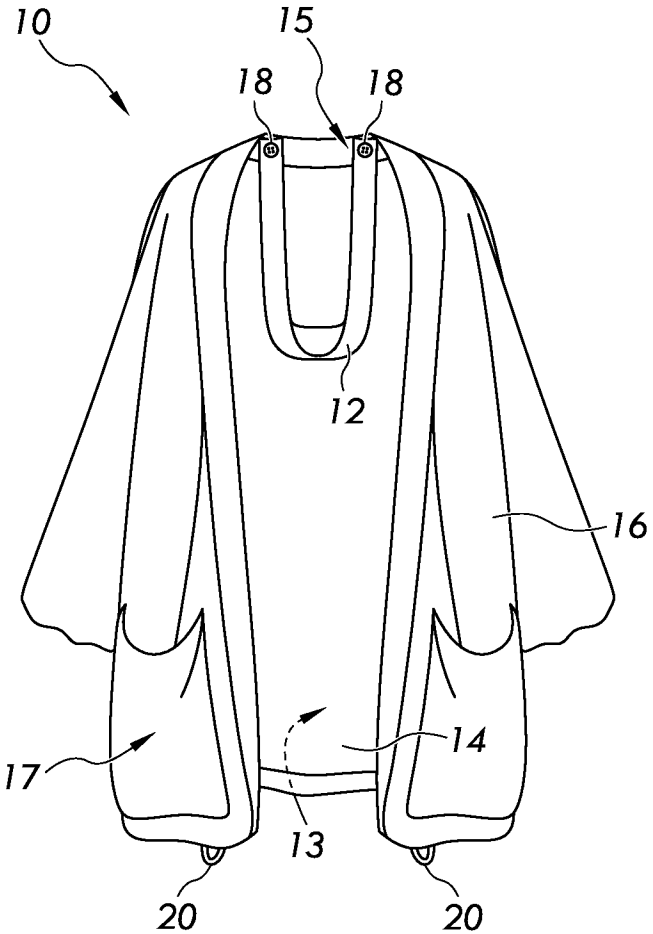
FIG. 1 is a front elevational view of a coat with a built-in strap.

FIG. 1 is a front elevational view of an outergarment such as a coat, generally indicated at 10. As shown in this embodiment, a strap 12 is sewn into coat 10 in the shoulder/collar area. The strap 12 is sized as a shoulder strap, and may be made of any suitable fabric. It may be sewn into the seam that joins the coat lining 14 with the outer layer 16 of the coat. With this arrangement, a wearer can doff the coat 10 and then use the strap 12 to carry it over one shoulder, like a messenger bag. The strap 12 can be adjustable and/or elastic.

The outergarment 10 of FIG. 1 is shown as relatively long, though in other embodiments it may be relatively short. In which case, nothing more may be needed—the coat 10 may simply be left to hang as it normally would about someone's shoulder by the strap 12. However, many coats are long, and it may damage a coat 10 if its bottom is left to drag on the ground. Therefore, the coat 10 has fastening mechanism that can be used to fold and secure it, thus making it shorter while being carried. As shown, the fastening mechanism can include a loop 20 and button 18 mechanism. Of course, the loops 20 can be less conspicuous than shown for this illustration. In fact, the loops can be hidden entirely from view when the coat 10 is being worn. Also, though the loops 20 are shown on the front portion 17 of the coat 10, the fasteners can also be on the back portion 13 of the coat 10. Further, the mechanism as shown in FIG. 1 by the portions 20 and 18 can also be snaps, hook and loop material, buckles, eye and turnbuckle, toggle or toggle clasp (e.g. bar attached to chain passing into and through a ring attached to a chain, the bar then turned about 90 degrees such that it will not pass through ring again), ties, zippers, magnets, or the like may be used as well as in combination with one another.

Figure 2:
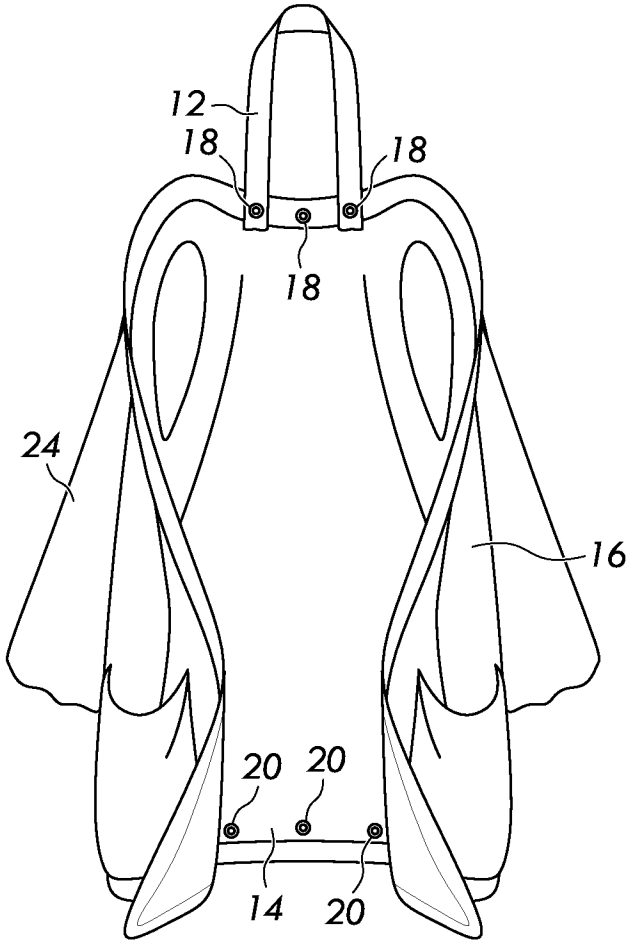
FIG. 2 is a front elevational view of the coat of FIG. 1 with the strap extended, illustrating its internal attachment.

As shown in the front view of FIG. 2, the fastening mechanism of the coat 10 has an upper set of fasteners 18 which are snaps, and a complementary lower set of fasteners 20, also snaps. As shown, there are three fastening mechanism pairs (snap pairs here), however, one or two fastening pairs can be used or up to many more than 3. The number of individual fasteners can often depend on the size and weight of the coat and other factors. In some embodiments, the upper set of fasteners 18 may comprise snaps hidden in the armpit region of the coat 10.

Figure 4:
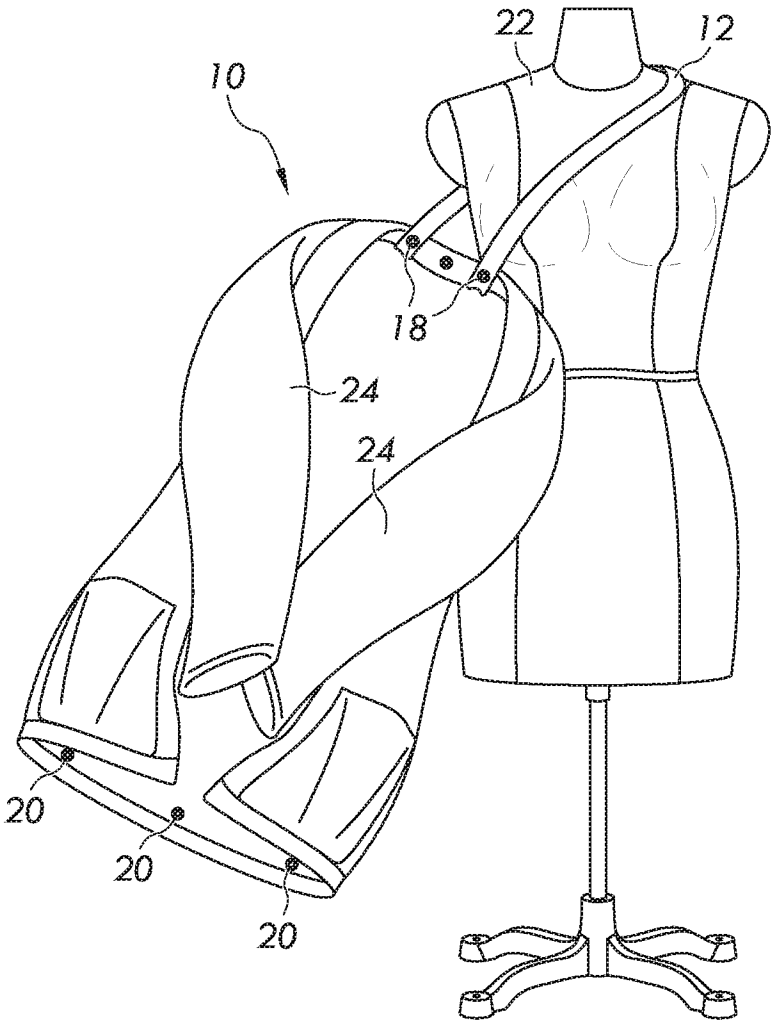
FIGS. 3-6 are schematic perspective views illustrating the steps of converting the coat from its as-worn configuration to a carry configuration.
Figure 3:
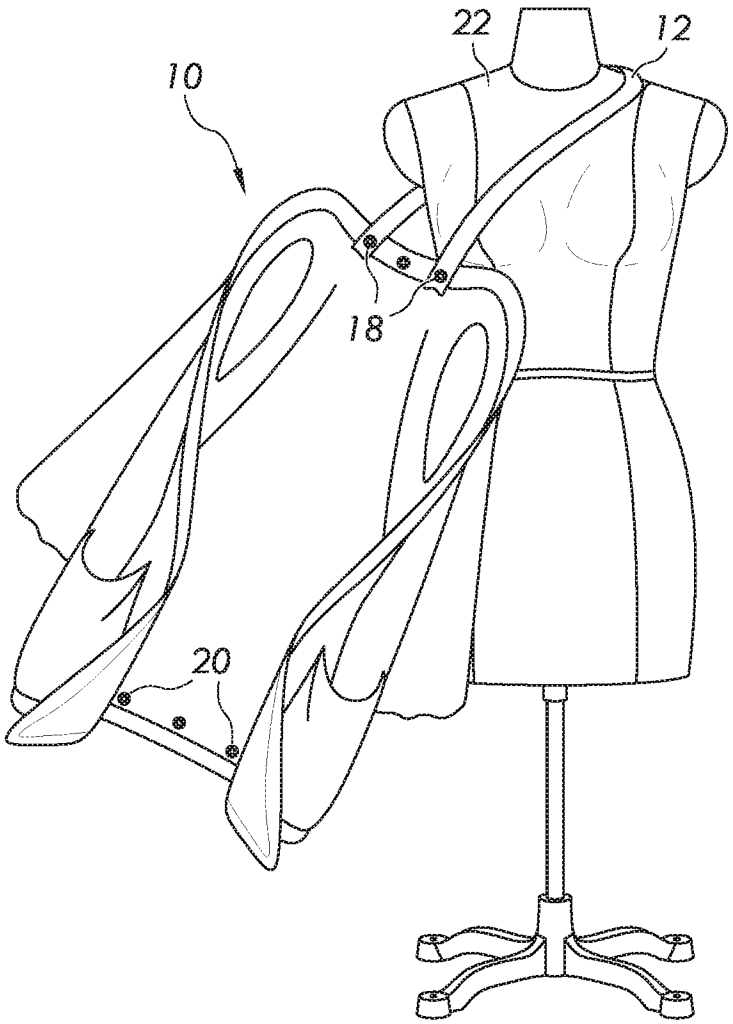
Figure 6:
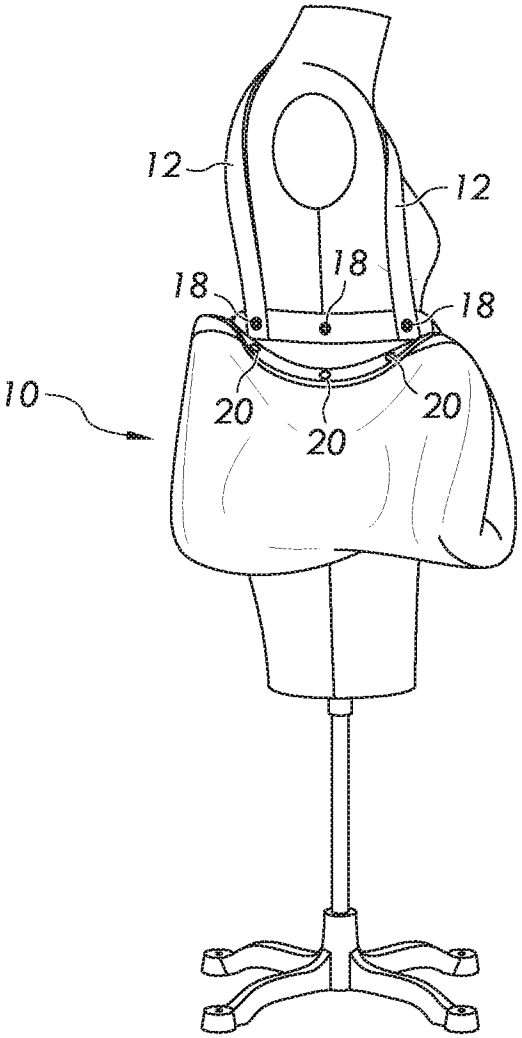
Figure 5:
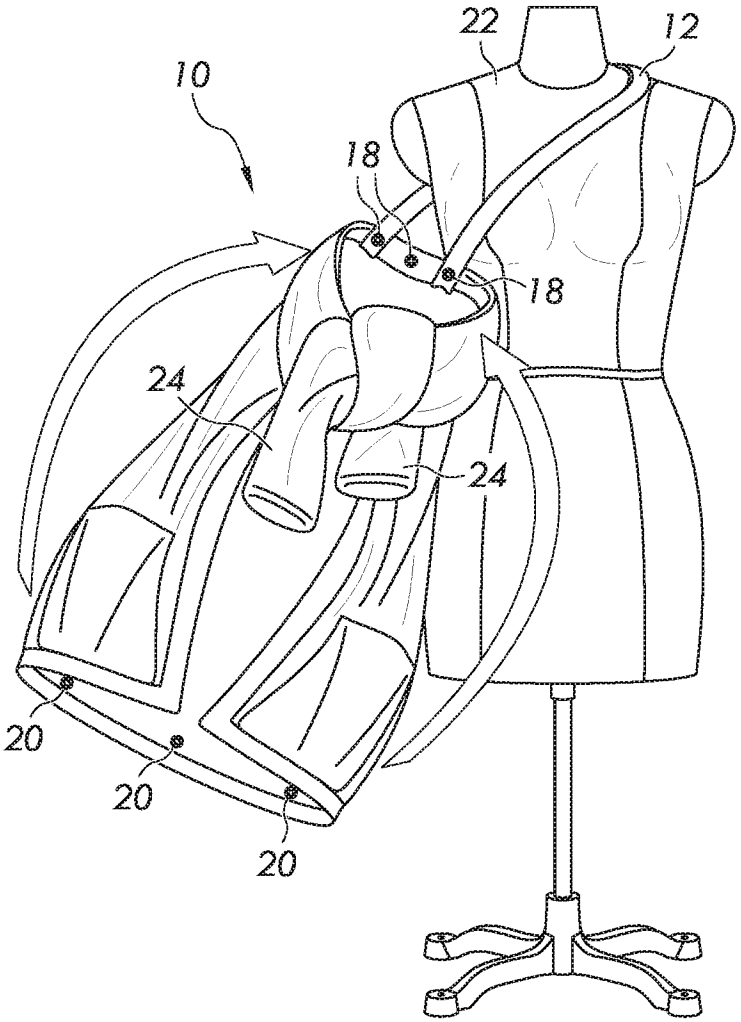

FIGS. 3-6 are successive schematic perspective views illustrating the process of converting the coat 10 for carrying or for using as a bag. As shown in FIG. 3, the strap 12 is extended and the coat 10 is slung over the model of the shoulder 22. Next as shown in FIG. 4, the sleeves 24 can be folded inward. In FIG. 5, the sleeves 24 are further folded and/or tied together. Then the bottom of the coat 10 is brought up, connecting the complementary sets of fasteners 18, 20. The coat 10 is shown in FIG. 6 in a carrying configuration. In the coat 10 of FIGS. 1-6, a strap 12 is sewn in to allow the coat 10 to be carried.

Figure 8:
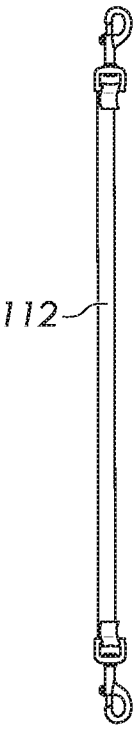
FIG. 8 is a side view of a removable strap.
Figure 7:
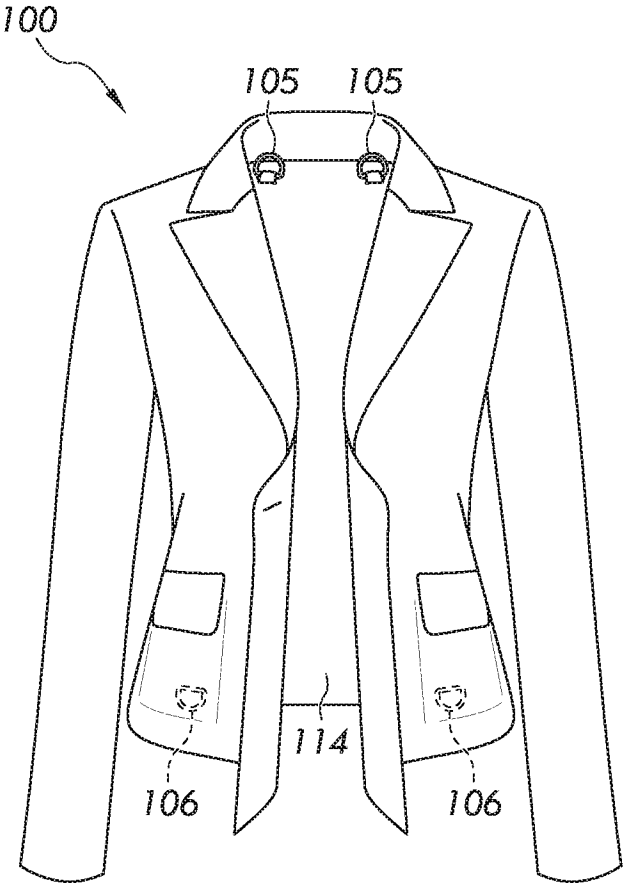
FIG. 7 is a front elevational view of a coat according to another embodiment of the invention.

However, this need not always be done. In FIG. 7 a front view of a coat 100 according to another embodiment of the invention is shown. The coat 100 includes a strap 112, as shown in FIG. 8, designed for being fastened and unfastened. As shown, both the upper rings 105 and the lower rings 106 are attached to the back 114 of the coat 100. The rings 106 can also be attached to the exterior front or interior front of the coat 100. This is true for all the garments in each figure of this application: The upper fasteners and lower fasteners can be on the inside front of the garment, the inside back of the garment, the outside front of the garment, the outside back of the garment.

Figure 9:
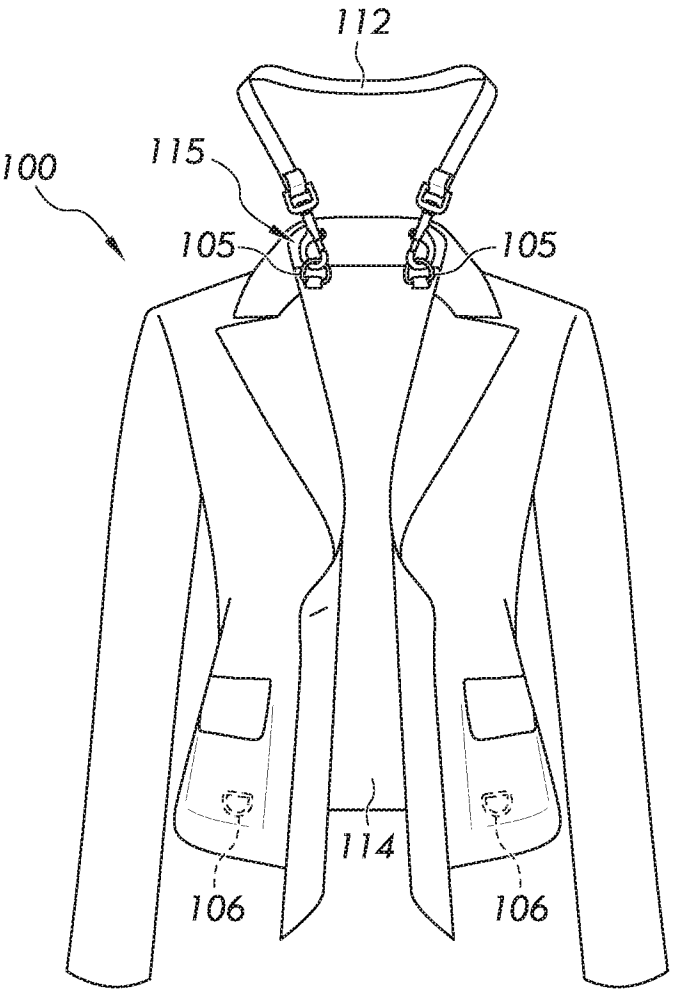
FIG. 9 is a front view of a coat according to another embodiment of the invention.

When the coat 100 is removed, the strap 112 can be connected to the upper rings 105 by the hook closures 115 of the strap as shown in FIG. 9. The coat 10 can then simply be carried by the strap 112 or by being carried with the strap 112 placed about one's shoulder.

Figure 10:
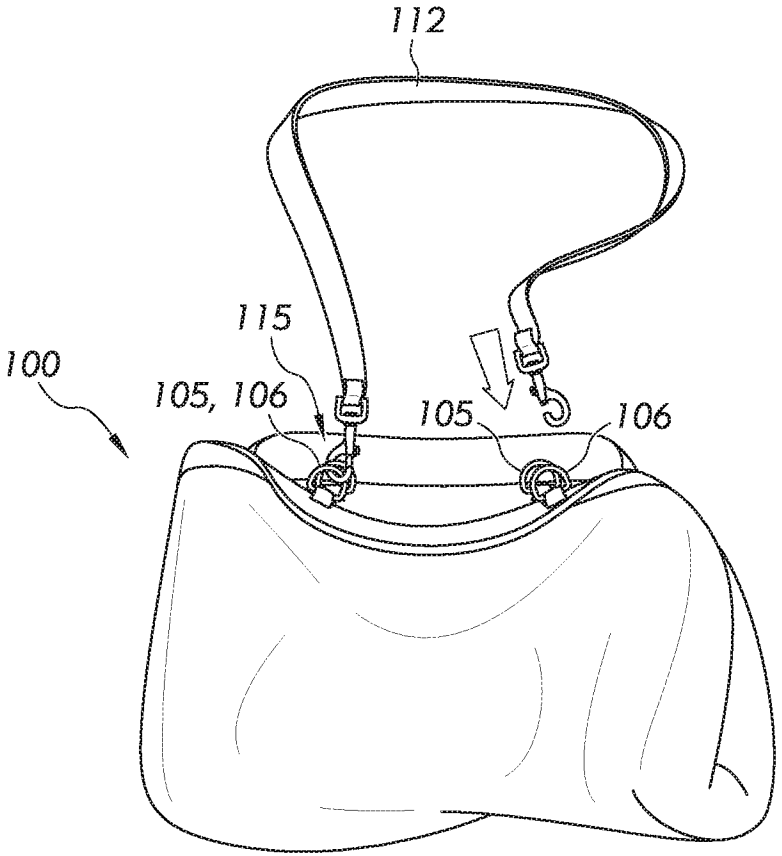
FIG. 10 is a front elevational view of a coat folded up with the strap being attached.
Figure 11:
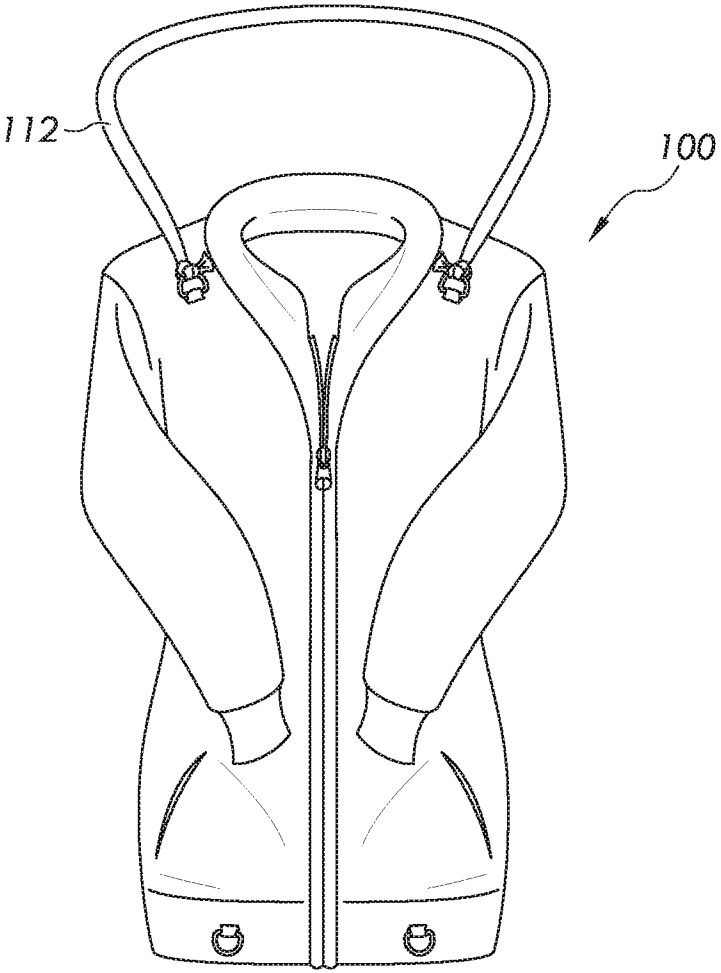
FIG. 11 is a front elevational view of a cardigan style sweater according to another embodiment of the invention.

Yet, when one would prefer that the carried garment 100 be shorter and/or if it is desired to be used as a bag, matching the upper rings 105 with the lower rings of 106 and attaching the hook closures 115 on each end of the strap 112 to an upper ring 105 and lower ring 106 pair will not only shorten the garment 100 being carried, but will also allow it to be used as a bag as shown generally in FIG. 10. As shown in FIG. 11 the upper and lower rings 105/106 are aligned together and held together by hook closures 115 of strap 112. The upper loops are shown as being on the outside of coat 100, but can also be on the interior. The coat 100 of FIG. 7 works in much the same way as does the garment 10 of FIG. 1 in the instance when rings 105/106 are also used on that garment 10 as used in the coat 100 of FIG. 7.

Figure 12:
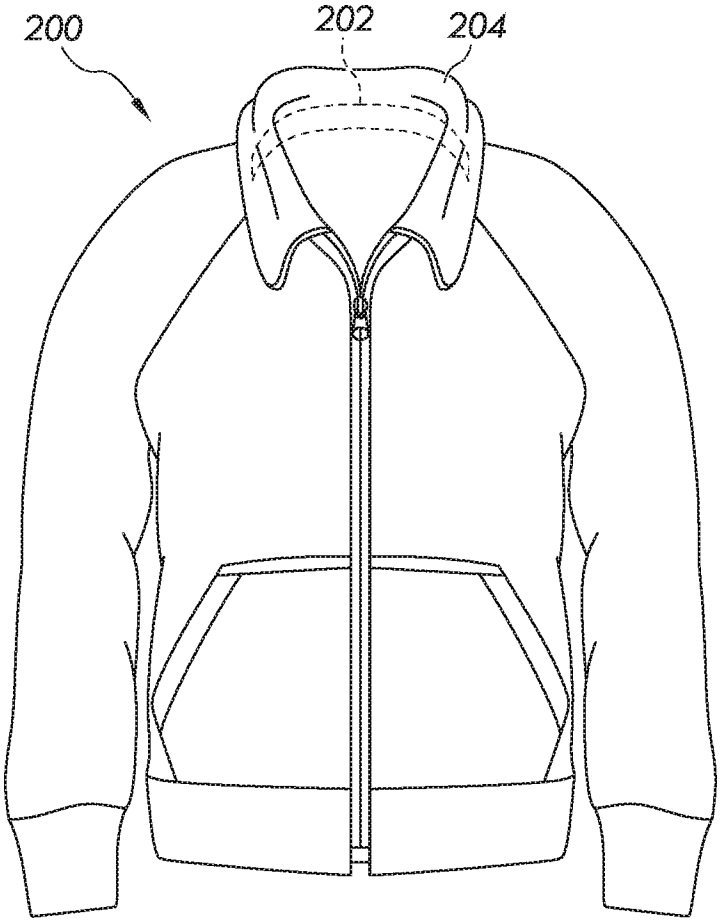
FIGS. 12 and 13 are front and rear elevational views, respectively, of a coat including a carrying strap in a pouch, according to yet another embodiment of the invention.
Figure 13:
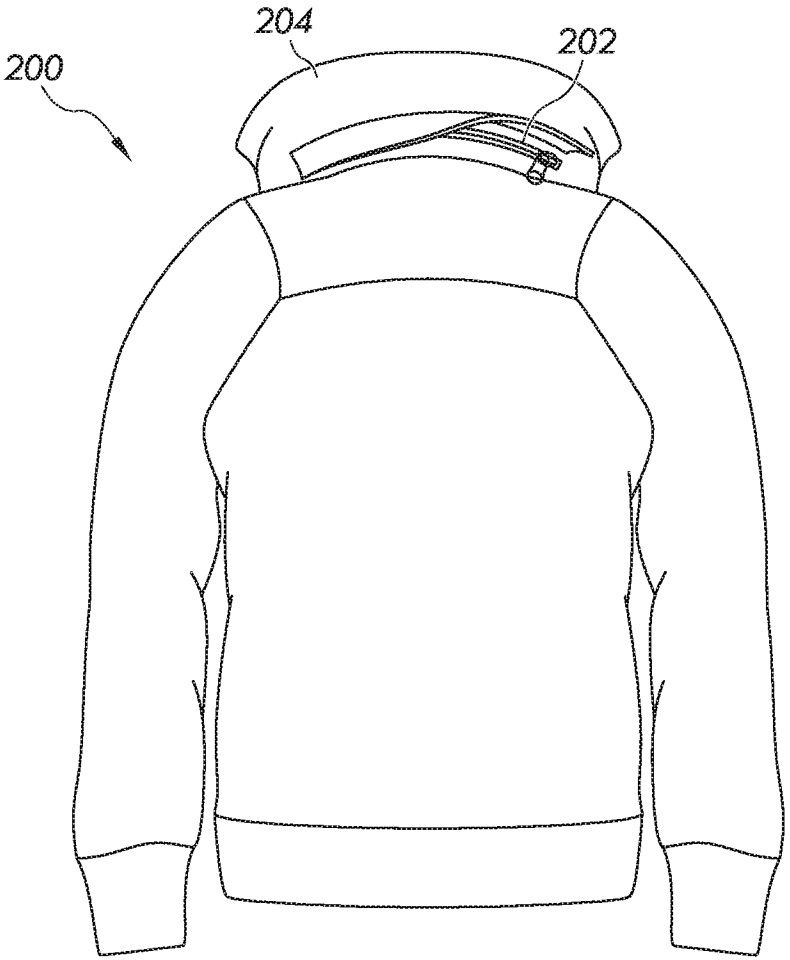

FIGS. 12 and 13 are front and rear views, respectively, of a coat, generally indicated at 200, according to another embodiment of the invention. In the coat 10 described above, a carrying strap 12 is permanently or detachably attached near the collar. In the coat 200, a pouch 202 is provided behind or under the collar 204. The pouch 202, which may be zippered or secured with VELCRO® hook-and-loop fastener, snaps, or any other suitable fasteners, contains a carrying strap. The strap may be permanently sewn into the coat 200 within the pouch, or it may be a separate piece, as is the strap 112 of FIG. 8, that is adapted to attach at an appropriate point with buttons, snaps, or other fasteners.

Figure 14:
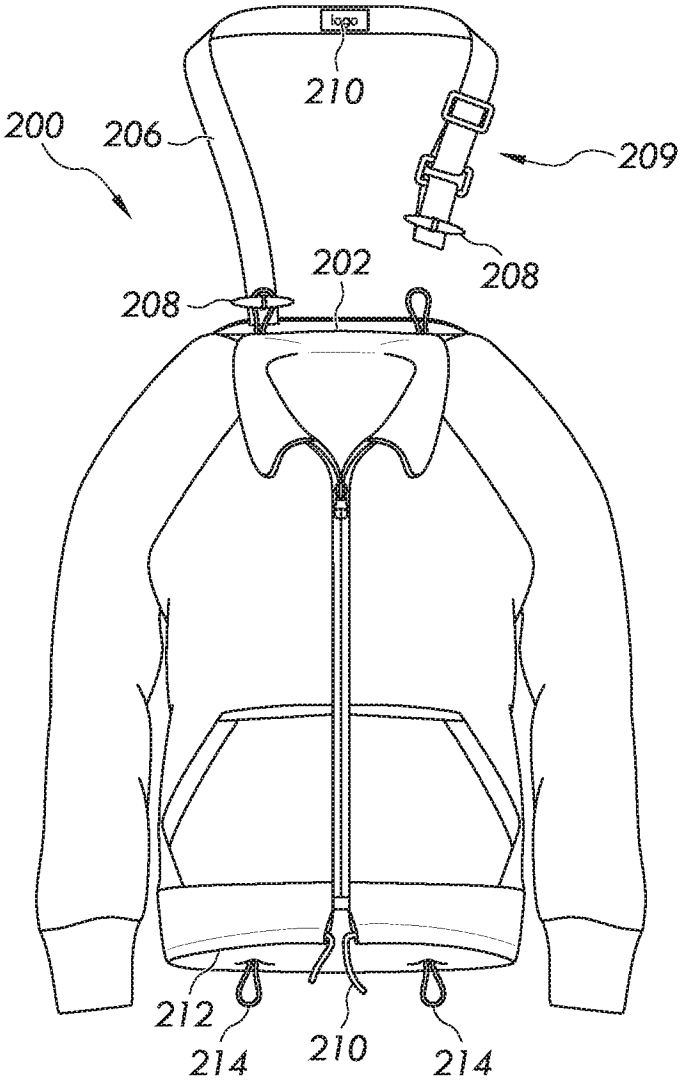
FIG. 14 is a front elevational view of the coat of FIGS. 12 and 13 with the carrying strap extended and being fully attached.

FIG. 14 is a front view of the coat 200 with the strap 206 extended out of the pouch 202. As shown, toggles 208 and other such structures may give the strap an adjustable length. FIG. 14 also illustrates another feature of some embodiments of the invention. As was described above, with longer coats 10, it is often helpful or advantageous to fold the coat 10 up in its carry configuration, in order to keep the bottom from dragging on the ground.

Particularly with short coats and sport jackets, including the coat 200 of FIGS. 12-14, the coat 200 may be converted into a bag to hold items while it is being carried. However, this feature may also be used with any longer coat 10 with a bottom intended to be folded up. As shown in FIG. 14, a draw string 210 is sewn within an appropriate channel 212 at the bottom of the coat 200. The user can pull the draw string 210 to cinch the bottom of the coat 200 closed, and then secure the cinched draw string 210 in place with toggles. In the illustrated embodiment, there are two pull-loops 214 that are used to fasten with fastener 208, although more or fewer may be used in other embodiments.

With the draw string 210 cinching the bottom of the coat 200 closed, and the coat 200 buttoned or zipped as it would be when worn, the user can use the coat 200 as a bag with a carry strap 206. While this type of arrangement can be used with any type of coat 200, it may be most useful with coats that have a continuous closure, like a zipper, which would make it less likely that items will fall out.

The strap 206 can also be adjustable having an adjustment portion 209 as shown in FIG. 14. There might also be a name tag or brand tag 210 on the strap 206.

As those of skill in the art will note, in the embodiments described above, the sleeves of the coat/sweater/garment 10, 100, 200 are specifically folded in during the process of converting the coat/sweater/garment 10, 100, 200 to be carried. However, other embodiments of the invention may automatically draw the sleeves inward as a carry handle is extended.

Figure 15:
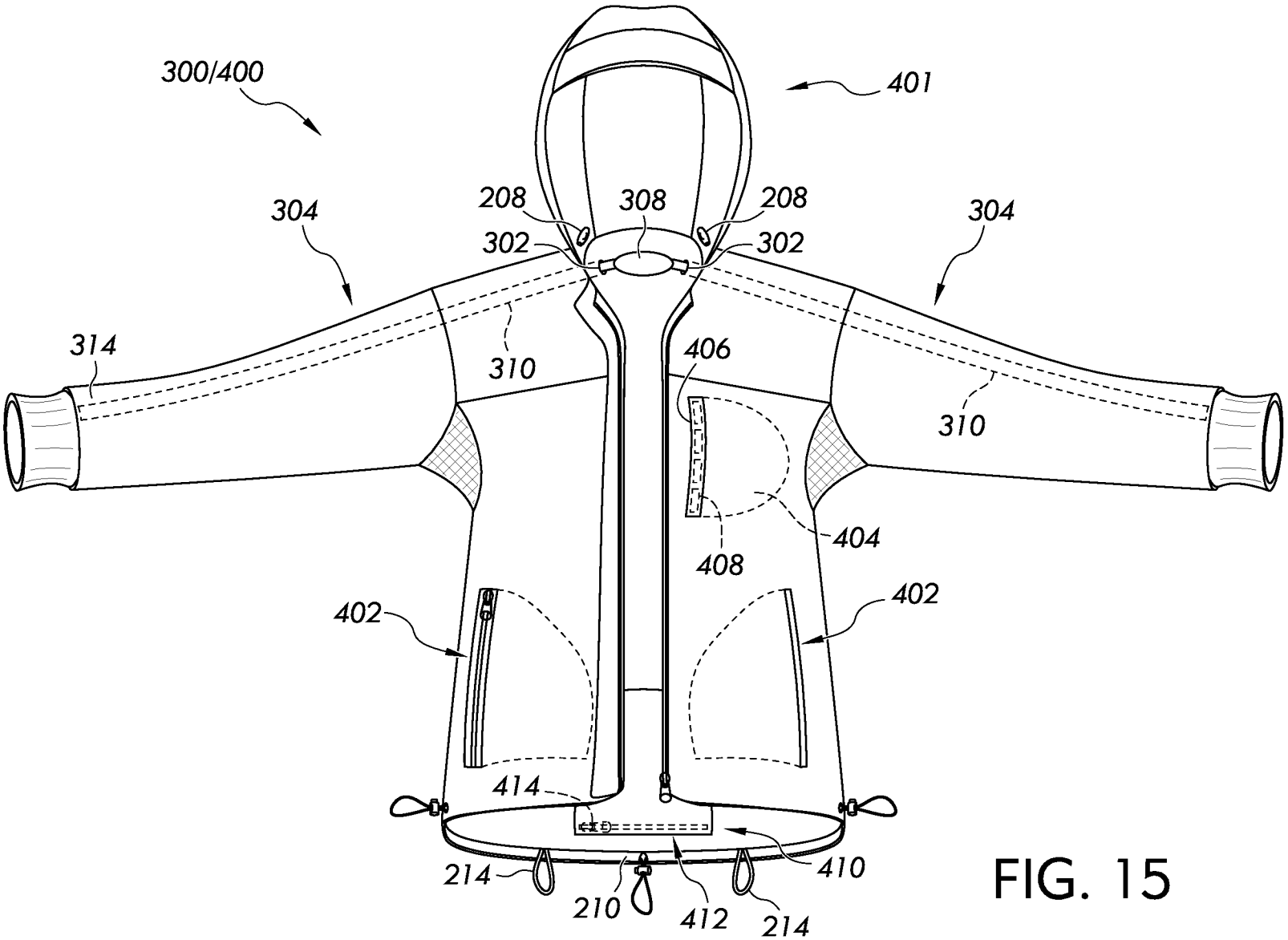
FIG. 15 is a front elevational view of an inventive coat.

FIG. 15 is a schematic view of a coat according to another embodiment of the invention, generally indicated at 300. Here multiple inventive elements are embodied in this single embodiment; one or more of these elements can also be extant in another garment without all the additional inventive elements shown. In an area of the coat 300, which may be under the collar as in previous embodiments, but may also be lower down along the back of the coat 300, the coat 300 includes two openings 302, which are aligned with and adjacent one another. In the illustrated embodiment, these two openings are roughly in line with the sleeves 304. Between the two openings 302 lies an area of fastener 306—e.g., one side of hook-and-loop fastener or snaps.

Figure 16:
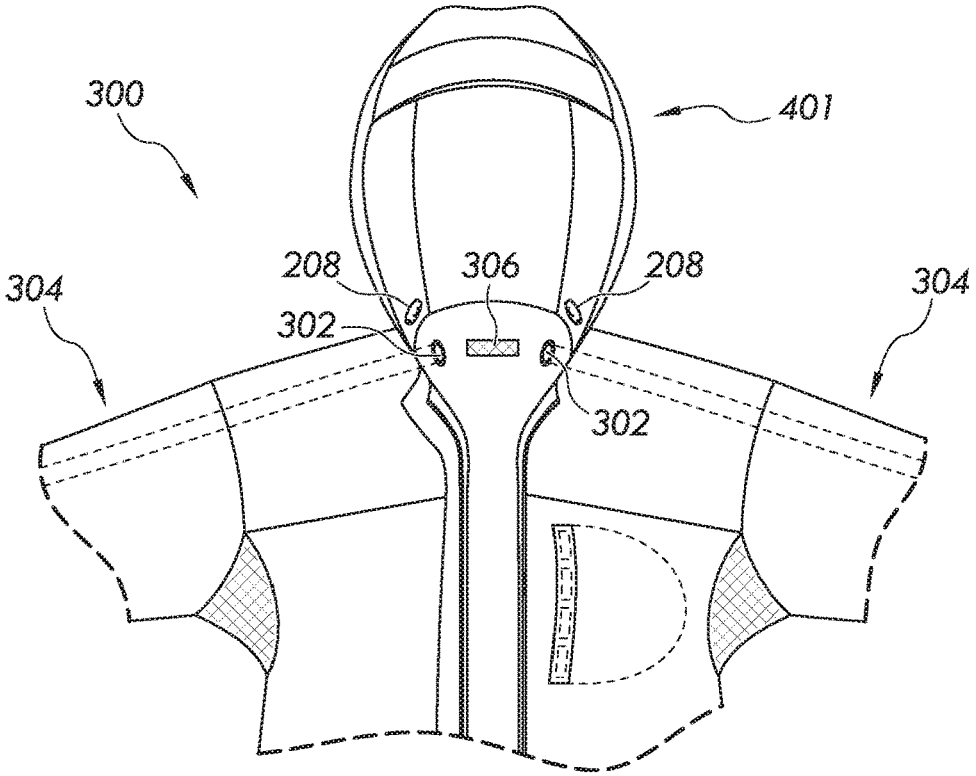
FIGS. 16 and 17 are schematic front elevational views of a coat with a retractable carrying strap according to a further embodiment of the invention.
Figure 17:
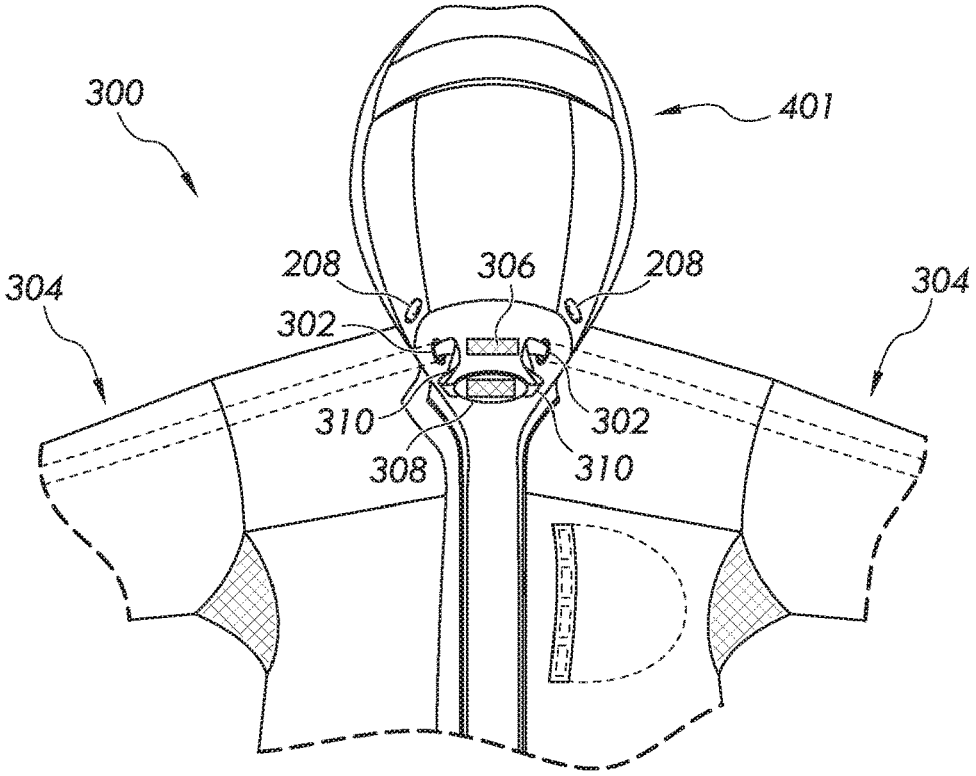

A handle 308 sized for a hand, which may be made of a relatively rigid material, like nylon or rubber, connects two cords 310 or attaches to a single, contiguous cord 310. FIGS. 16 and 17 help in illustrating this. As shown in FIG. 16 a connecting mechanism 306 can be used; the mechanism 306 can help keep the handle 308 down and/or flat against the back of the coat 300. On its underside, the handle 308 includes a complementary fastener to attach to the fastener 306 between the openings, so as to remain in place when not needed. Snaps, a zipper, a hook and loop material, a button and loop mechanism, a clasp and loop or hole mechanism, a magnet mechanism, among others may be used alone or in any combination thereof.

The cord 310, with the handle 308, comprises a carry strap, but its arrangement within the coat 300 is slightly different than in other embodiments.

The cord 310 may be at least somewhat elastic, either because it is made of an inherently elastic material, or because it is made of a composite of materials that, together, have elasticity. For example, the cord 310 may be made of the same types of materials of which typical "bungee-type" elastic cords are made. Other length adjustment materials can be used (e.g. Velcro straps with or without buckles). As shown in the schematic rear elevational view of FIG. 18, the cord 310 is secured to the end of each one of the sleeves 304 and extends within tubes 314 made, e.g., of nylon. Typically, the tubes 314 with the cord 310 would be placed between the shell of the coat 310 and its inner lining. In some embodiments, the cord 310 is better described as a strap. In fact, the cord in some embodiments can be a strap having a width anywhere between ⅛" to 3".

Figure 18:
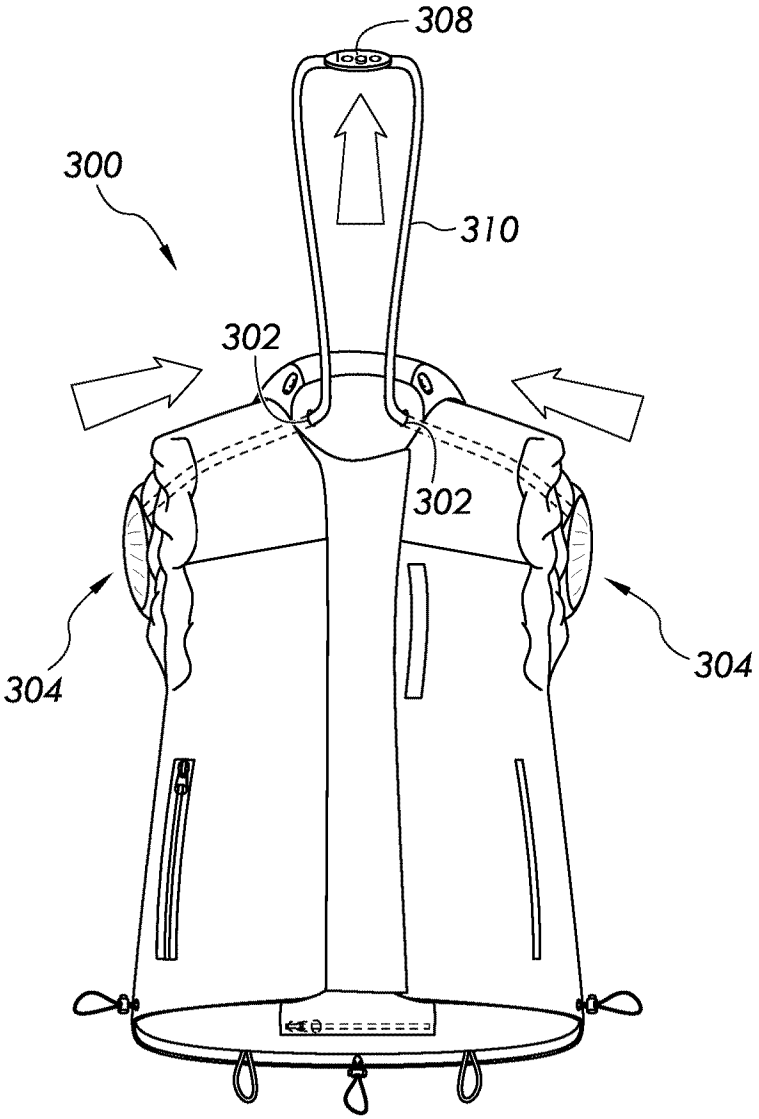

As shown in FIG. 18, when one pulls on the handle 308 to extend the cord 310, which acts as a strap, because the cord 310 is attached to the ends of the sleeves 304, the sleeves 304 are "automatically" drawn inward toward the body of the coat 300. Typically, they will be "bunched up" in appearance. The appearance of the coat 300 with its strap 310 extended is shown in the schematic view of FIG. 18. The coat 300 may also have a draw string 210 at its bottom, so that it can be closed. Thus, the coat 300, like the previous embodiment, may be used as a tote or carry bag.

While the features of the coat 300 may be included with any kind of coat, it may be helpful, because of the bunching of the sleeves 304 when the cord/strap 310 is extended, if the material of at least the sleeves 304 is not particularly prone to wrinkling, or if wrinkling is not a concern. In some embodiments, the material of the sleeves 304 is able to sustain repeated bunching without damage.

In additional instances, coats according to embodiments of the invention may include features intended to be used when the coat is in its carrying configuration. Looking again at FIG. 15, an illustration of a coat 400, that includes a built-in strap 310 and carry features, as well as features intended to be used when the coat is in its carrying configuration. More specifically, in addition to a complement of regular pockets 402, which may be entirely external or partially internal, and may be open, zippered, or closed with other types of closures, the coat 400 includes a pouch or pocket 404 with an opening 406 that faces laterally. As one example, the pocket 404 may have a magnetic clasp 408. The coat 400 can have an interior pocket 410 in the lining with an opening 412 that, in the illustrated embodiment, faces down. A zipper 414 closes the pocket 410. The coat 400 may have any other features common in clothing as well. In some embodiments a hood (e.g. a bill shaped hood) can be incorporated into the coat 400.

Figure 19:
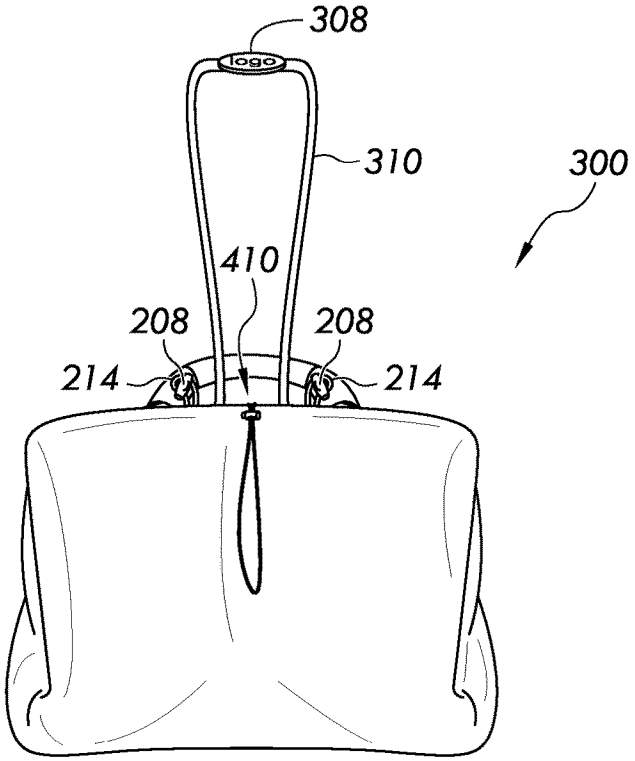
FIG. 19 is a front elevational view of the coat being folded into a tote bag condition.

There can also be a bungee cord 210 capable of being tightened and loosened through an adjustment mechanism 416 (e.g. a capped barrel style cord lock) in order to tighten the hem. When a coat 300/400 has cord 310 pulled up the arms 304 pull up as illustrated in FIG. 18. The coat can be folded and then the pull loops (or a ring or another fastening portion) 214 can be fastened to the toggles (or hook or another fastening portion) 208 as shown in FIG. 19. The interior pocket 410 is available to be used as a carrying/storage compartment in addition to the space formed by folding the jacket and engaging the fasteners. The pouch 410 can then be open and closed using a zipper or other fasteners 414.

As with the other inventive embodiments herein, the embodiments of FIGS. 15-18 need not include folding and fastening the coat 300/400 into a tote bag. Instead, it can simply be carried about one's neck and shoulder by extending the strap 310 and having the arms 304 compact into the body of the coat 300 and the rest of the coat hang free.

The above disclosure is intended to be illustrative and not exhaustive. This description will suggest many variations and alternatives to one of ordinary skill in this art. The various elements shown in the individual Figures and described above may be combined or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An outergarment having an upper portion and a lower portion and further comprising:

a first sleeve and a second sleeve attached to a central portion;

a cord extending proximate of the end of the first sleeve to proximate of the end of a second sleeve, the at least one cord passing through the central portion;

the cord having a handle; the handle disposed within the central portion;

wherein when the handle is pulled, the two sleeves are drawn inward, toward the central portion, and the at least one cord, extended, serves as a shoulder strap.

2. The outergarment of claim 1, wherein the cord extends, at least partially, between two material layers of the outergarment.

3. The outergarment of claim 2, further comprising a pair of openings through which the cord protrudes to expose the handle.

4. The outergarment of claim 3, wherein the cord is elastic.

5. The outergarment of claim 4, wherein the cord is enclosed within a tube as it runs between the central portion and the ends of the two sleeves.

6. The outergarment of claim 1, wherein a bottom portion includes a closing mechanism to close the bottom portion of the outergarment to secure items placed in the outergarment, the closing mechanism selected from the group consisting of: a draw string, a zipper, a hook and loop material, a button and loop mechanism, a clasp and loop or hole mechanism, a magnet mechanism, a folding mechanism, and any combination thereof.

7. The outergarment of claim 1, wherein a bottom portion of the outergarment and the upper portion of the outergarment include fastener portions, the fastener portions on the lower portion being constructed and arranged to couple with the fastener portions on the upper portion.

8. The outergarment of claim 7, having the fastener portions on the lower portion coupled with the fastener portions on the upper portion thereby folding the outergarment and creating a space such that the outergarment can be used as a bag.

9. The outergarment of claim 8 having an unfolded configuration and a folded configuration, in the unfolded configuration the outergarment having a bag with an opening such that the opening hangs downward, in the folded configuration the mouth of the bag is upward and allows items to be placed therein.

10. The outergarment of claim 9 wherein the opening has a closing mechanism to close the bag and open the bag.

11. The outergarment of claim 10 wherein the closing mechanism is selected from the group consisting of: a draw string, a zipper, a hook and loop material, a button and loop mechanism, a clasp and loop or hole mechanism, a magnet mechanism, a folding mechanism, and any combination thereof.

* * * * *